United States Patent [19]

Kamberg

[11] 4,428,133

[45] Jan. 31, 1984

[54] HEAT EXCHANGER FOR FLATWORK IRONER'S

[75] Inventor: Eduard Kamberg, Chicago, Ill.

[73] Assignee: New Super Laundry Machinery Co, Inc., Chicago, Ill.

[21] Appl. No.: 422,895

[22] Filed: Sep. 24, 1982

[51] Int. Cl.[3] ..... D06F 65/02

[52] U.S. Cl. ..... 38/44

[58] Field of Search ..... 38/18, 44–51, 38/52, 53–55, 56, 100; 100/93 RP, 92 R; 34/110, 119; 431/20, 71

[56] References Cited

U.S. PATENT DOCUMENTS

| | | | |
|---|---|---|---|
| 2,322,957 | 6/1943 | Sullivan | 38/49 |
| 2,825,156 | 3/1958 | Kinzelman | 38/44 |
| 3,476,492 | 11/1969 | Roberts | 431/71 |
| 4,288,934 | 9/1981 | Gasser | 38/44 |
| 4,299,555 | 11/1981 | Kamberg | 431/20 |

*Primary Examiner*—Louis Rimrodt
*Assistant Examiner*—Andrew M. Falik
*Attorney, Agent, or Firm*—Edward C. Threedy

[57] ABSTRACT

A heat exchanger, by which the entire ironing surface of a commercial laundry flatwork finisher is uniformly heated, includes a chest ironing surface backed by a fluid cavity that is in turn externally heated by a gas burner. A temperature control element is immersed in the heat transfer fluid and reduces temperature differential across the entire ironing surface allowing the machine to be operated continuously and more efficiently.

4 Claims, 3 Drawing Figures

HEAT EXCHANGER FOR FLATWORK IRONER'S

SUMMARY OF THE INVENTION

The present types of commercial laundry flatwork finishers are heated by means of either gas, steam, or electricity. Many of these particular types of flatwork finishers are installed in institutions, motels, hotels, and restaurants. The gas heated machine is by far the most popular, due to the economy of gas, its availability, and the fact that gas is a fast method of heating equipment of this nature.

However, certain disadvantages have always been associated with gas heating of this type of machinery. Due to the necessity of having to sense the temperature of the externally heated surface by conventional thermostatic heat controls there results a generally large differential in temperature across the ironing surface. Hot spots are created on the finishing surface when the operator fails to use the entire available finishing surface resulting in uneven temperature distribution across the surface resulting in unsatisfactory finished work or scorched material.

To eliminate the disadvantages of the commercial available flatwork finishers the present invention provides for a cavity on the flatwork finisher heated chest with such cavity being filled with a heat transfer fluid. The heat transfer fluid being in contact with the entire wall of the chest ironing surface evenly distributes the heat thereto. This means of heat transfer eliminates hot spots and through the employment of a sensing element immersed in the heat transfer fluid reduces the temperature differential between the ironing surface and the thermostatic heat control.

A further object of this invention is to provide a heat exchanger which will more efficiently transfer heat more evenly over an enlarged surface, thus eliminating temperature fluctuations even when very heavy and extreme damp work is run through the machine.

Yet another object of the invention is to provide, through the heat exchanger, a more constant evenly disbursed heat whereby the machine may be continuously used at its maximum speed of operation.

Other objects will appear hereinafter.

DESCRIPTION OF THE DRAWINGS

The invention will be best understood by reference to the accompanying drawings which illustrate the preferred form of construction by which the stated objects of the invention are achieved, and in which.

GENERAL DESCRIPTION

Figure 1:
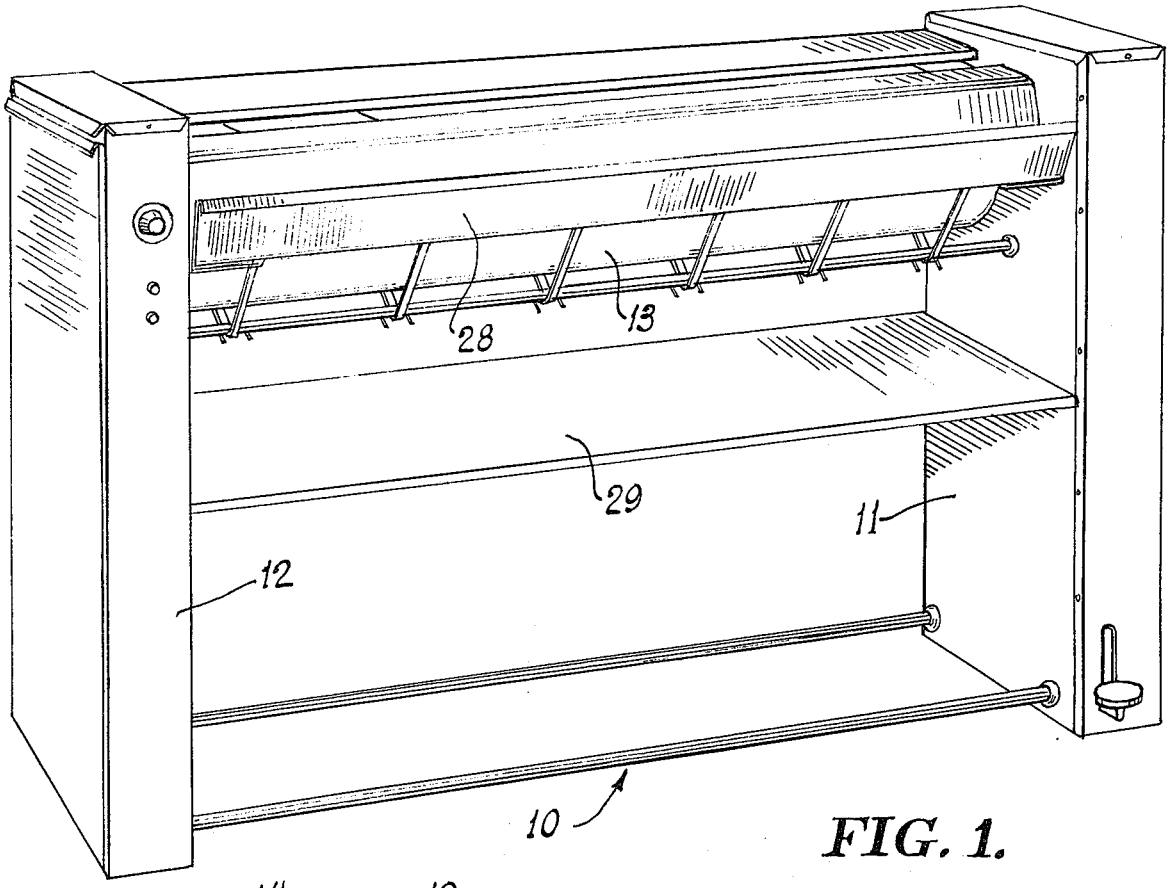
FIG. 1 is a perspective view of a commercial laundry flatwork finisher.

The commercial laundry flatwork finisher to which this invention pertains consists of a machine 10 as illustrated in FIG. 1. The machine 10 includes two end panels 11 and 12 between which is rotatably mounted the padded pressure roll 13. The control mechanisms for the operation of the pressure roll are contained in the end panels 12 and 13 and make up no part of the present invention.

Mounted between the end panels 11 and 12, rearwardly of the pressure roll 13, is the heat chest 14. The heat chest 14 is constructed with an arcuated front ironing surface 15. By a spaced wall 16 there is provided a fluid cavity 17 rearwardly of and extending throughout the length of the chest 14.

Figure 2:
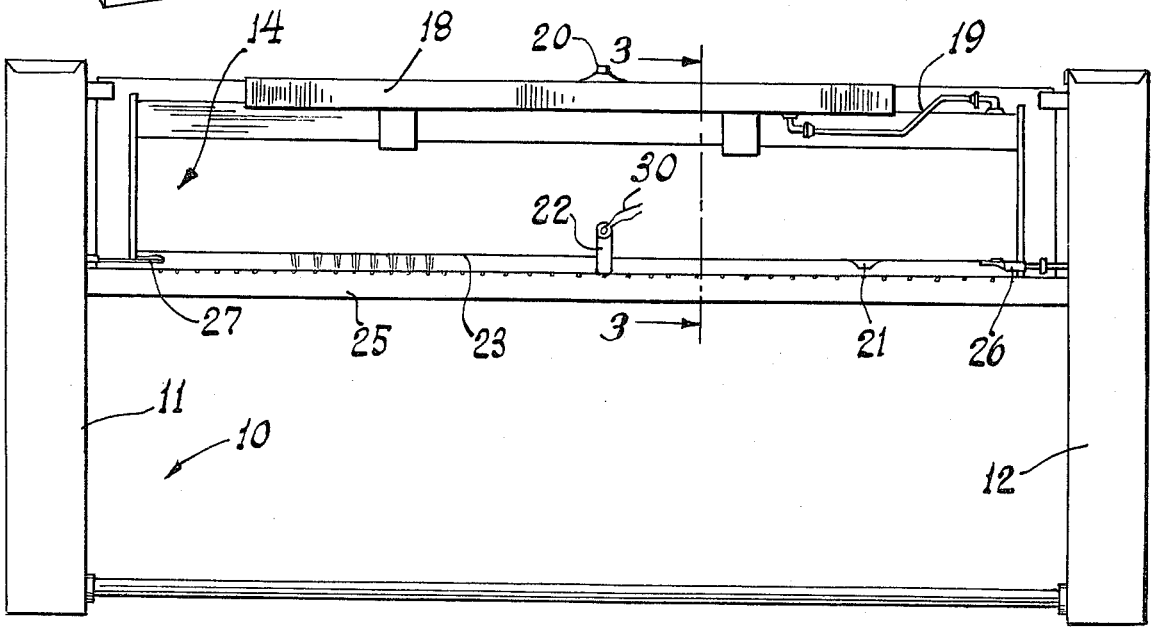
FIG. 2 is a rear elevational view of a commercial laundry flatwork finisher embodying the present invention.
Figure 3:
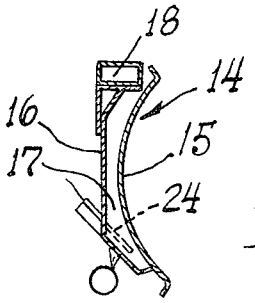
FIG. 3 is a fragmentary detailed sectional view of the heat exchanger of the present invention.

Extending between the end panels 11 and 12 and to the rear of the arcuated ironing surface 15 and above the fluid cavity 17 is an elongated expansion tank 18. By a suitable conduit 19 the uppermost area of the fluid cavity 17 is in communication with the expansion tank 18 as viewed in FIG. 2. The fluid cavity 17 is also provided with a breather cap 20 which may include a liquid level gauge of any type suitable for such function as well as a drain 21.

A thermostatic unit 22 is connected to the rear wall 23 of the fluid cavity 17 and positions within such cavity 17 a thermostat bulb 24.

Extending between the end panels 11 and 12 and immediately below the fluid cavity 17 is an elongated gas burner 25. This gas burner 25 includes a spark ignitor 26 adjacent one end and at the opposite end a flame sensor 27. The construction, arrangement of parts, and function of the gas burner 25, spark ignitor 26, and flame sensor 27 are standard equipment and operate in the manner shown and described and claimed in U.S. Pat. No. 3,476,492, dated Nov. 13, 1967, and U.S. Pat. No. 4,299,555, dated Nov. 10, 1981.

As shown in FIG. 1, the machine 10 provides a feed table 28 which is in close proximity to the padded pressure roller 13. This feed table extends the full width between the end panels 11 and 12 and provides a work holding area so that work to be finished can be rapidly fed into the machine.

The machine also provides a receiving table 29 which allows the finished work to be conveniently folded after it has been finished.

The operator will select a prescribed operating temperature for the machine and this will be controlled through the thermostatic unit 22. As the bulb 24 is immersed in the fluid within the cavity 17, it will be more accurately responsive to the true temperature of the volume of fluid and, in turn, evenly distribute the heat onto the heat chest 14. The thermostatic unit 22 by an electrical conductor 30 is connected to the controls of the machine 10 in a manner well known in the art.

In practice it has been found that an operator, when using the machine, will introduce varying sizes of work onto the roller for engagement with the heated chest 14. This, in ordinary machines, created different areas of heat, the lesser heated area being that portion of the machine that was repeatedly used. Thus, when a larger piece was introduced into the machine it would contact hot spots on the heat transfer element many times scorching the material. By the use of a liquid heat transfer agent within the fluid cavity 17 such a condition is avoided. The constant uniform temperature of the liquid is maintained by reason of its inherent characteristics.

In the event that the machine is in long continuous use, the overflow tank will readily receive any abnormal expansion of the heat transfer liquid from the fluid cavity 17.

From the foregoing it is obvious that the construction of the elements of this invention results in a fluid filled chest which retains more heat for transfer onto the chest ironing surface and includes a system which virtually eliminates temperature fluctuation even when very heavy and extremely damp work is run through the machine. The arrangement permits a constant temperature which allows work to be processed at maximum speeds. It should also be noted that the benefit of the even heat distribution across the ironing surface and its associated close temperature control allows the machine to be operated at higher temperatures with a resulting higher production of finished work.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention what I claim as new and desire to protect by Letters Patent is:

1. A heat exchanger for a commercial laundry flatwork finisher having a rotatable finishing roller comprising, (a) an ironing member having a chest surface with a configuraion proportional to the diameter of the finishing roller, (b) a fluid cavity formed on the back side of said chest surface of said ironing member adapted to be filled with a heat transfer liquid, (c) means for heating the liquid within said fluid cavity, (d) temperature sensing means within the liquid in said cavity for indicating temperature thereof, (e) an expansion tank in communication with said fluid cavity, and (f) means providing open communication between said expansion tank and said fluid cavity.

2. A heat exchanger as defined by claim 1 wherein said means for heating the liquid within said fuel cavity comprises a gas burner extending beneath and exteriorly of said fluid cavity for heating the liquid therein.

3. A heat exchanger as defined by claim 1 wherein said expansion tank is mounted upon the top surface of said fluid cavity and has an open conduit connection therewith through which expanding heated liquid is permitted to flow.

4. A heat exchanger as defined by claim 3 wherein said means for heating the liquid within said fuel cavity comprises a gas burner extending beneath and exteriorly of said fluid cavity for heating the liquid therein.

* * * * *